United States Patent [19]

Leveque

[11] 4,242,151

[45] Dec. 30, 1980

[54] CHROMIZING OF STEELS BY GASEOUS METHOD

[75] Inventor: Robert Leveque, Firminy, France

[73] Assignee: Creusot-Loire, Paris, France

[21] Appl. No.: 87,954

[22] Filed: Oct. 24, 1979

[30] Foreign Application Priority Data

Oct. 25, 1978 [FR] France ..... 78 30308

[51] Int. Cl.[3] ..... C23C 11/04; C23C 11/16

[52] U.S. Cl. ..... 148/6.35; 148/16.6; 204/177; 427/38; 427/253

[58] Field of Search ..... 427/38, 39, 252, 253, 427/249, 255.4, 328; 148/16.6, 6.35; 204/192 N, 164, 177

[56] References Cited

U.S. PATENT DOCUMENTS

| | | | |
|---|---|---|---|
| 3,190,772 | 6/1965 | Berghaus et al. | 148/16.6 |
| 3,282,746 | 11/1966 | Zlotek et al. | 427/252 |
| 3,730,863 | 5/1973 | Keller | 148/16.6 |

FOREIGN PATENT DOCUMENTS

| | | | |
|---|---|---|---|
| 2053013 | 3/1971 | Fed. Rep. of Germany | 148/16.6 |

*Primary Examiner*—Ralph S. Kendall

*Attorney, Agent, or Firm*—Haseltine, Lake & Waters

[57] ABSTRACT

The object of the present invention is an improvement in chromizing methods, constituted by a method of chromizing steels to a depth e greater than 30 microns, usable for steels with a carbon content of at least 0.2%, especially for steels for construction work and steels for tools, characterized by the combination of three successive treatments, the first of these three treatments consisting of an ionic nitriding of a surface layer between 100 and 350 microns thick, this ionic nitriding being realized in an atmosphere constituted by a mixture of nitrogen and hydrogen, at a temperature of between 450° C. and 650° C., for between 5 and 40 hours, so as to obtain between 1.5% and 2.5% nitrogen in the nitrided layer, the second of these treatments consisting of a chromizing by gaseous method forming chromium carbides, lasting between 5 and 30 hours, and realized at temperatures of between 850° C. and 1,100° C., the third of these three treatments being a thermal treatment comprising a quenching in oil of the chromized piece followed by a tempering at a temperature of between 600° C. and 650° C., lasting between 30 minutes and 10 hours, depending on the size of the piece treated.

3 Claims, No Drawings

CHROMIZING OF STEELS BY GASEOUS METHOD

FIELD OF THE INVENTION

The present invention concerns an improvement in chromizing by gaseous method steels with more than 0.2% carbon, more especially steels for construction work and steels for tools; this improvement allows the thickness of the chromized layer, as well as its toughness, to be increased to a very considerable extent.

BACKGROUND

The chromizing of steels by gaseous method is well known. The formation of chromium-based diffusion alloys on the surface of steels has already been described in many patents. The transfer of chromium to the surface of the material to be treated is done by means of halides, which are the only compounds with chromium to exist in the vapor state at diffusion temperatures. The passage of the chromium into solid solution in the metal is effected by exchange between the chromium halide and the iron according to a reaction which, in the case of chlorides, can be written:

$$CrCl_2(g)+Fe(s)\rightarrow FeCl_2\,(g)+Cr(s) \quad (1)$$

To obtain a sufficient diffusion, the reaction must be effected at high temperature and in the austenitic range, that is to say over 850° C. for conventional steels. In steels whose carbon content is greater than 0.2%, the surface reaction of the carbon and chromium involves on the one hand the formation of a skin of chromium carbides and on the other hand a diffusion of carbon towards the surface. The surface skin is formed of two types of carbides, $M_{23}C_6$, richer in chromium towards the surface and $M_7C_3$, poorer in chromium towards the metal substrate.

In what precedes and follows, M designates a metal such as iron (Fe), chromium (Cr), nickel (Ni), etc. . . .

The surface skin has a thickness of between 12 and 18 microns, and a level of hardness between 1200 and 1800 on the Vickers hardness scale. Generally, the chromium thus diffuses in the steel to a depth of nearly 15 Microns. In known methods, this chromizing depth never exceeds 20 microns.

The affinity of chromium for carbon is such that it very rapidly forms a skin of carbides of the $M_7C_3$ type on the surface of the pieces as the treatment temperature rises. This skin impedes the penetration of the chromium into the steel by diffusion; from this results:

(1) the formation of the second type of carbides $M_{23}C_6$, (2) the obtaining of relatively thin, surface layers of carbides.

These thin, two-phase layers have the drawback of being relatively brittle, because of the state of stresses existing in the carbide phases after thermal treatment. The carbide $M_7C_3$, columnar in structure, especially exists in a state of tensile stress, which gives rise to the forming of cracks which are often the origin of the flaking observed.

SUMMARY OF THE INVENTION

The principal object of the present invention is to find a means allowing the obtaining of one single type of carbide forming a layer of greater thickness at the surface. A rapid passage of the piece to be treated to the austenitic phase would constitute a solution for two reasons:

(1) The diffusion of carbon towards the surface is slowed down; in fact, the coefficient of diffusion of the carbon in volume in the austenitic phase of iron is of the order of $10^{-8}$ cm$^2$/sec at 900° C., whereas it is near $2.10^{-6}$ cm$^2$/sec. at the same temperature in the ferritic phase. As a result there is a consequent reduction in the speed of formation of carbides at the surface and an increase in the diffusion of chromium in depth.

(2) The carbide $M_{23}C_6$, of face-centered cubic structure, has a mesh a of 10.6 A, practically three times larger than that of austenite (a=3.6 A). This carbide consequently precipitates more easily in the austenitic structure than the carbide $M_7C_3$ of hexagonal structure.

Consequently, a first solution for increasing the thickness and toughness of the layers of carbides can be constituted by an initial phase of treatment consisting of a rapid temperature rise, especially in the 600°-900° C. range in which the carbides $M_7C_3$ normally precipitate in the ferritic structure. However, such a solution will present risks of checking and cracks beginning during heating, especially in pieces made of relatively mixed steels presenting geometries hardly suited to the great stresses of thermal origin which would result from such a heating cycle.

The present invention, while applying the principle of chromizing the piece in the austenitic phase, avoids the afore said risks by producing as a peliminary a nitrided layer, but without a combination layer, that is to say, in such a way that there is absolutely no formation of a surface layer of iron and chromium nitrides. In fact, a surface layer of iron nitrides would remain relatively stable, even at high temperatures, and would constitute a real barrier to the diffusion of chromium, this barrier being reinforced by the formation of chromium nitrides associated with an additional deposit of nitrogen.

Thus the absence of a combination layer on the surface of pieces to be subsequently treated by chromizing is a necessary condition for a good diffusion of chromium at depth, and this condition is realized in the present invention.

To this end, the object of the present invention is an improvement in chromizing methods, constituted by a method of chromizing steels to a depth e greater than 40 microns, usable for steels with a carbon content equal to at least 0.2%, especially for steels for construction work and for steels for tools, characterized by a combination of three successive treatments, the first of these three treatments consisting of an ionic nitriding of a surface layer between 100 and 350 microns thick, this ionic nitriding being achieved in an atmosphere constituted by a mixture of nitrogen and hydrogen, at a temperature of between 450° C. and 650° C., for between 5 and 40 hours, so as to obtain between 1.5% and 2.5% nitrogen in the nitrided layer, the second of these treatments consisting of a chromizing by gaseous method forming chromium carbides, lasting between 5 and 30 hours, and realized at temperatures of between 850° C. and 1,100° C., the third of these three treatments being a thermal treatment comprising a quenching in oil of the chromized part followed by a return to a temperature of between 600° C. and 650° C., lasting between 30 minutes and 10 hours, depending on the size of the piece to be treated.

According to one particular feature of the present invention, the ionic nitriding forming the first of the three treatments and effected in an atmosphere of nitrogen and hydrogen is realized under a partial pressure for nitrogen of at the most 1.5 millibars, and under a total gaseous pressure of between 2 and 10 millibars.

According to another particular feature of the present invention, the chromizing forming the second of the three treatments, realized by the known technique for cements in a hydrogen-based reducing atmosphere, uses a powdery mixture with a base of ferro-chromium and ammonium chloride, this latter representing only 0.4% to 1% of the powdery mixture by weight, the ferro-chromium powder preferably presenting a chromium content of between 50% and 75% and a particulate size distribution between 0.5 of a millimeter and 4 millimeter, without the aluminous or magnesian binder.

DETAILED DESCRIPTION

Throughout the preceding and the following, "ionic nitriding" must be taken to mean a thermo-chemical treatment of a metal surface by ionic bombardment with rarified gas, realizing surface nitriding of the metal piece placed as a cathode under a nitrogen and hydrogen atmosphere at a temperature of between 450° C. and 650° C.

The principal advantage of ionic nitriding is that it renders feasible the use of all the possibilities offered by the equilibrium diagrams between the elements constituting the treated steel and nitrogen. In fact, thermo-chemical treatments of metal surfaces by ionic bombardments and more particularly nitriding are based on the properties of electrical discharge in rarified gases, which are, in these circumstances, mixtures of nitrogen and hydrogen, with, if need be, hydrocarbons. The reactive gaseous atmosphere can be selected independently of the necessity for its thermal cracking since its activation is obtained by ionization. It is consequently possible to regulate the partial pressure of nitrogen in such a way that, at the surface, the phase or phases provided by the iron-nitrogen equilibrium diagram is or are formed. Thus, at the lowest nitrogen pressures, only one diffusion layer, a solid solution of nitrogen in $\alpha$ iron, is formed, at temperatures generally between 450° and 570° C. In this same range of temperature, an increase in the partial pressure of nitrogen leads firstly to the forming of a combination layer of $\gamma'$ nitrides ($Fe_4N$), and then of $\gamma'$ and $\epsilon$ nitrides ($Fe_{2,3}N$).

In the case of steels with more than 0.2% carbon and more especially steels for construction work and steels for tools, it is possible to obtain nitrogen diffusion layers between 100 and 350 microns thick, this ionic nitriding being realized in an atmosphere constituted by a nitrogen and hydrogen mixture, at a temperature of between 450° and 570° C., for between 5 and 40 hours so as to obtain, for example, at depths of 50 to 200 microns from the surface, contents of nitrogen in solid solution of between 1.5 and 2.5%.

As will be understood, one of the principal advantages of the invention consists, thanks to ionic nitriding, in obtaining a nitrided layer without a combination layer, that is to say without iron and chromium nitrides, in a reliable and repeatable way by adjustment of the partial pressure of nitrogen as a function of the treatment temperature and the chemical composition of the steel. Without risk of cracking, the steel at the surface can then pass rapidly into the austenitic phase at a moderate temperature, because of a nitrogen content of the order of 1.5% to 2.5%.

After this, chromizing by gaseous method can be effected at greater depth, for example, up to 50 microns and even more, and with the surface formation of a single type of carbonitride, $Cr_2(C,N)$, which gives rise to an appreciable increase in the toughness of the coating.

In order that the inventiom may be fully understood, by way of non-limiting example, an embodiment of the improvement according to the invention will be described hereinafter, in which a chromium-molybdenum-Vanadium steel, of the 35CDV12 type, and consequently with 0.35% carbon, is treated, in order to obtain a depth of chromizing of 50 microns.

The ionic nitriding which forms the first of the three successive treatments according to the invention is here effected in a metal vessel provided with thermal shields and cooled by the circulation of water, which vessel constitutes the earthed anode. The electrical parameters are chosen in such a way that the current increases with the direct voltage produced by the generator and the sample to be nitride which constitutes the cathode becomes covered by the glow discharge corresponding to the conditions of abnormal discharge. The gaseous ions are formed near the cathodic surface and accelerated towards the sample, causing it to heat up, this being continued until the temperature selected for realizing the thermochemical treatment is reached. Temperature regulation is obtained by means of a thermocouple protected by an aluminum casing and placed in the sample in conditions which allow the striking of arcs to be avoided.

The pressure at which the thermo-chemical treatment is carried out is generally between 2.5 and 8.0 millibars; a primary pump is sufficient to make the initial vacuum and then to allow the nitriding gas close to the sample to be renewed. The nitriding gaseous mixture is composed of nitrogen and hydrogen. The partial pressures $P_N$ of nitrogen at which a solid solution of nitrogen is obtained in the lattice of the ferrite are between 0.1 and 0.5 of a millibar. The temperature is regulated to an average at 530° C. and does not go beyond the range of between 510° and 530° C. Disregarding the rise in temperature and the lowering of the pressure of the atmosphere, the duration of the ionic nitriding at the correct pressure and temperature is 25 hours. Through this first treatment, the average nitrogen content of the steel at depths of between 50 to 200 microns reaches 2.1% and the nitride layer contains no iron nitrides of chromium nitrides.

The metal piece of 35 CDV 12 steel thus nitrided is then extracted from the ionic nitriding furnace and introduced into a cementation tank which is to effect the second treatment according to the invention, which is a chromizing by gaseous method.

The cementation agent used is a powder constituted 99.5% by ferro-chromium with 60/70% chromium and 0.5% by ammonium chloride, with no aluminum or magnesium oxide. This powder presents a particulate size distribution comprised between 0.5 and 4 mm, with an average dimension of about 2.7 mm. This powder is disposed in the bottom of the cementation tank, which is shaped like a vertical cylinder, and is covered by a partition on which is placed the piece of steel to be chromized. On the upper part of the cementation tank, in a carrier, is a reserve of ferro-chromium for direct regeneration of the active vapor of chromium chloride $CrCl_2$. Hydrogen introduced creates a reducing atmosphere.

The vessel is brought to an average temperature of 950° C., without leaving the range 920° C. -980° C., for 20 hours.

The following phenomena occur in the cementation tank:

On heating, the ammonium chloride dissociates. The chloride ion thus liberated acts on the chromium of the ferro-chromium so as to form chromium chloride $CrCl_2$ in the vapor state, which produces the surface chromizing in accordance with the reaction (1) mentioned above.

The ferrous chloride vapors produced by the reaction (1) react with the reserve of chromium placed at the upper part of the tank, which regenerates the gaseous chromium chloride $CrCl_2$ which plays a part in the chromizing according to (1).

After 20 hours at 920° C. -980° C., the chromized piece undergoes the third treatment according to the invention, that is to say it is extracted from the cementation tank, immediately quenched in oil and then introduced into a tempering furnace kept at a temperature of the order of 625° C., for 2 hours.

After tempering, it is observed:

that the surfae layer containing the chromium carbonitrides is nearly 50 microns thick, that the chromium carbonitrides of this surface layer are almost exclusively of the $Cr_2(C,N)$ type, that the hardness of this layer is between 1800 and 2000 on the Vickers scale, that it cracks under a load of 1 kilogram weight.

The chromized coating thus obtained in the present example according to the invention can be compared with that of a chromizing of known type, not preceded by an ionic nitriding. In this case of known type:

the surface layer containing the chromium carbides is nearly 15 microns thick, two phases of chroimium carbides are observed in it, one of $M_{23}C_6$, mainly at the surface, the other of $M_7C_3$, towards the metal substrate, the hardness of the surface layer is between 1200 and 1800 on the Vickers scale, with heterogeneities associated with surface porosities, the load which causes cracks at the angles of Vickers indentations is 300 grams weight.

One can, of course, devise variants and improvements of detail as well as envisage the use of equivalent means, without going beyond the scope of the invention.

What is claimed is:

1. Improvement in the methods of chromizing steels, steels to a depth greater than 40 microns, usable for steels with a carbon content of at least 0.2%, comprising the combination of three successive treatments, the first of these three treatments consisting of an ionic nitriding of a surface layer between 100 and 350 microns thick, this ionic nitriding being carried out in an atmosphere constituted by a mixture of nitrogen and hydrogen, at a temperature of between 450° C. and 650° C., for between 5 and 40 hours, so as to obtain between 1.5% and 2.5% of nitrogen in the nitrided layer, the second of these three treatments consisting of a chormizing by gaseous method forming chromium carbides, lasting between 5 and 30 hours, and realized at temperatures of between 850° C. and 1,100° C., the third of these three treatments being a thermal treatment comprising an oil quenching of the chromized piece followed by a tempering at a temperature of between 600° C. and 650° C., lasting between 30 minutes and 10 hours, depending on the size of the piece to be treated.

2. The method of chromizing steels according to claim 1, wherein the ionic nitriding forming the first of the three treatments and carried out in an atmosphere of nitrogen and hydrogen is realized under a partial pressure of nitrogen of 1.5 millibars at the most, and under a total gaseous pressure of between 2 and 10 millibars.

3. The method of chromizing steels according to claim 1 or 2, in which the chromizing forming the second of the three treatments is carried out by the known cement technique, in a hydrogen-based reducing atmosphere, and uses as cement a powdery mixture with a base of ferro-chormium and ammonium chloride, wherein the powdery mixture contains between 0.4% and 1% ammonium chloride, and wherein the ferro-chromium powder has a chromium content of between 50% and 70% and a particulate size distribution of between 0.5 of a millimeter and 4 millimeters, without aluminous or magnesian binder.

* * * * *